US008760063B2

(12) United States Patent
Zhao

(10) Patent No.: US 8,760,063 B2
(45) Date of Patent: Jun. 24, 2014

(54) MULTI-OUTPUT SELF-BALANCING POWER CIRCUIT

(71) Applicant: Silergy Semiconductor Technology (Hangzhou) Ltd, Hangzhou (CN)

(72) Inventor: Chen Zhao, Hangzhou (CN)

(73) Assignee: Silergy Semiconductor Technology (Hangzhou) Ltd, Hangzhou (CN)

( * ) Notice: Subject to any disclaimer, the term of this patent is extended or adjusted under 35 U.S.C. 154(b) by 0 days.

(21) Appl. No.: 13/737,150

(22) Filed: Jan. 9, 2013

(65) Prior Publication Data

US 2013/0181620 A1 Jul. 18, 2013

(30) Foreign Application Priority Data

Jan. 12, 2012 (CN) ..... 2012 1 0008352

(51) Int. Cl.
*H05B 37/00* (2006.01)
*H05B 39/00* (2006.01)
*H05B 41/00* (2006.01)

(52) U.S. Cl.
USPC ..... 315/188; 315/185 R; 315/186; 315/254; 315/257

(58) Field of Classification Search
None
See application file for complete search history.

(56) References Cited

U.S. PATENT DOCUMENTS 8,508,157 B2 * 8/2013 Kim et al. ..... 315/308
2010/0237799 A1 * 9/2010 Choi et al. ..... 315/294

FOREIGN PATENT DOCUMENTS

CN 102316620 * 1/2012
CN 102316620 A 1/2012

* cited by examiner

*Primary Examiner* — Anh Tran
(74) *Attorney, Agent, or Firm* — Michael C. Stephens, Jr.

(57) ABSTRACT

The present invention relates to a multi-output self-balancing power circuit. In one embodiment, a multi-output self-balancing power circuit can include: a transformer formed by a primary winding and n (e.g., greater than 2) series connected secondary windings; n output circuits corresponding to the n secondary windings, where each of the n output circuits can include a rectifier diode and a filter capacitor, and a load can be parallel coupled with the filter capacitor; n output circuits series coupled between a first output terminal of a first secondary winding and a second output terminal of an $n^{th}$ secondary winding; and (n−1) current balancing capacitors coupled between a common junction of n secondary winding and a common junction of n output circuits.

6 Claims, 4 Drawing Sheets

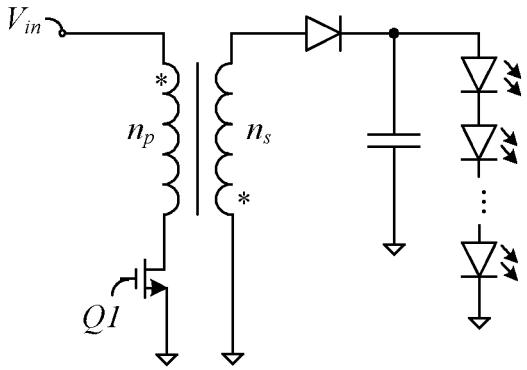
FIG. 1 (conventional)

MULTI-OUTPUT SELF-BALANCING POWER CIRCUIT

RELATED APPLICATIONS

This application claims the benefit of Chinese Patent Application No. 201210008352.2, filed on Jan. 12, 2012, which is incorporated herein by reference in its entirety.

FIELD OF THE INVENTION

The present invention relates to a multi-output power circuit, and more specifically to a multi-output self-balancing power circuit.

BACKGROUND

A plurality of light-emitting diodes (LEDs) may be assembled together in high-efficiency and high-brightness lighting applications. The brightness of LEDs directly may be directly related to the current flowing through the LEDs. In general, the LEDs may be much brighter as the current is higher. In order to achieve balanced-brightness between a plurality of LEDs, multiple LEDs may be connected in series, and a primary controlled flyback may be utilized as a driver for the LEDs. As shown in FIG. 1, a current flowing through the LED strings can be controlled by controlling switch Q1 according to a primary current. However, only one LED string can be driven by this topology, and if the quantity of series connected LEDs is more than a certain number, the voltage across the LED string may be much higher. As a result, the withstand voltage of the rectifier diode may be increased to meet the requirements, and it may be difficult to improve system conversion efficiency. In addition, design and production costs may be increased as a large bulk capacitor is employed as the filter capacitor.

SUMMARY

In one embodiment, a multi-output self-balancing power circuit, can include: (i) a transformer formed by a primary winding and n secondary windings, where a first input terminal of the primary winding can be applied to receive an input voltage, a second input terminal of the primary winding can be coupled to ground via a switch, and an output current of the power circuit can be controlled by controlling the states of the switch; (ii) the n secondary windings can be coupled in series, a first output terminal of each of n secondary windings and the second input terminal of the primary winding can be dotted terminals, and a second output terminal of each of n secondary windings and the first terminal of the primary winding can be dotted terminals, where n can be an integer of at least two; (iii) n output circuits corresponding to the n secondary windings, where each of n output circuits can include a rectifier diode and a filter capacitor, a load can be parallel coupled with the filter capacitor, and n output circuits can be series coupled between a first output terminal of a first secondary winding and a second output terminal of an $n^{th}$ secondary winding; and (iv) (n−1) current balancing capacitors coupled between a common junction of n secondary windings and a common junction of n output circuits.

Embodiments of the present invention can advantageously provide several advantages over conventional approaches. For example, current balancing between multi-output circuits can be achieved by applying current balancing capacitors, and cross voltages on the different output loads can be largely reduced as compared to the single output circuit. Also, requirements for rectifier diode and filter capacitor can be reduced. Further, the system conversion efficiency can be improved as the conduction losses of rectifier diodes may be decreased, and as relatively small bulk capacitors can be applied as filter capacitors. In addition, product costs can be lower and the circuit volume can be smaller to facilitate the design of circuit structure. Other advantages of the present invention may become readily apparent from the detailed description of preferred embodiments below.

BRIEF DESCRIPTION OF THE DRAWINGS

FIG. 1 is a schematic diagram of an example conventional primary controlled flyback driver for LED strings.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Figure 2:
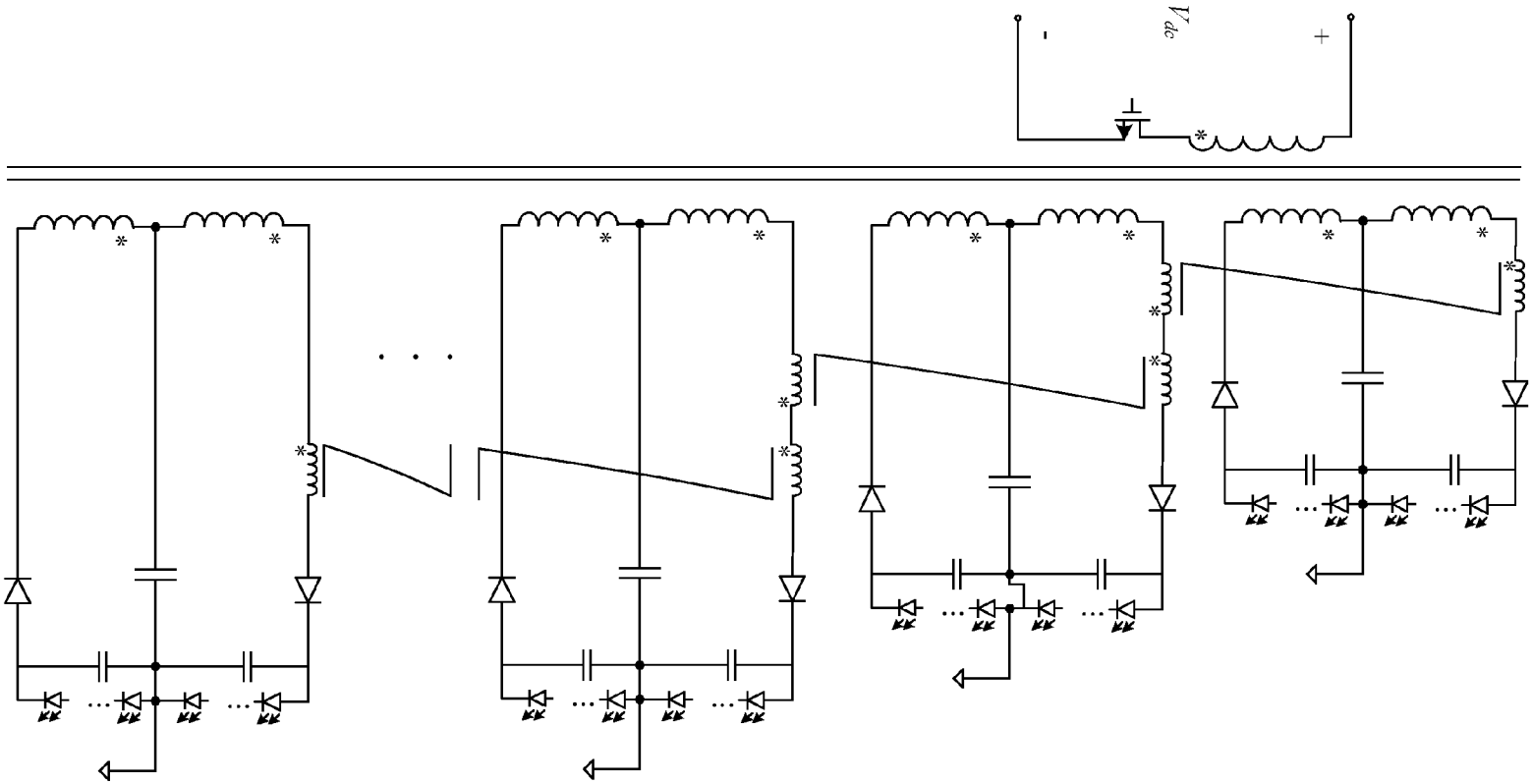
FIG. 2 is a schematic diagram of an example multi-output current balancing power circuit using current balancing transformers.

In order to alleviate the above-stated problems, a multi-output power circuit can be employed as a light-emitting diode (LED) driver. However, this approach may suffer from current imbalances between the LED strings. Also, with an active control strategy to balance the load currents, the circuit structure may have increased complexity, resulting in low reliability and high cost. With reference to FIG. 2, an example multi-output DC power supply circuit is shown. In this example, each secondary-winding can be divided into a first winding and a second winding by a tap, and each rectifier loop with respect to the first winding and the secondary winding can be connected to a blocking capacitor.

Current balancing transformers configured between a plurality of secondary windings can be used to achieve current balancing. Although current balancing can be achieved between the LED strings by applying current balancing transformers and blocking capacitors, it may be difficult to add in current balancing transformers between two adjacent secondary windings. Also, the product costs may be increased, as well as the circuit volume. Further, the reliability may be reduced, the leakage inductance may be increased, and a voltage peak on the rectifier diode may be too high, thus requiring a higher withstand voltage.

Figure 3:
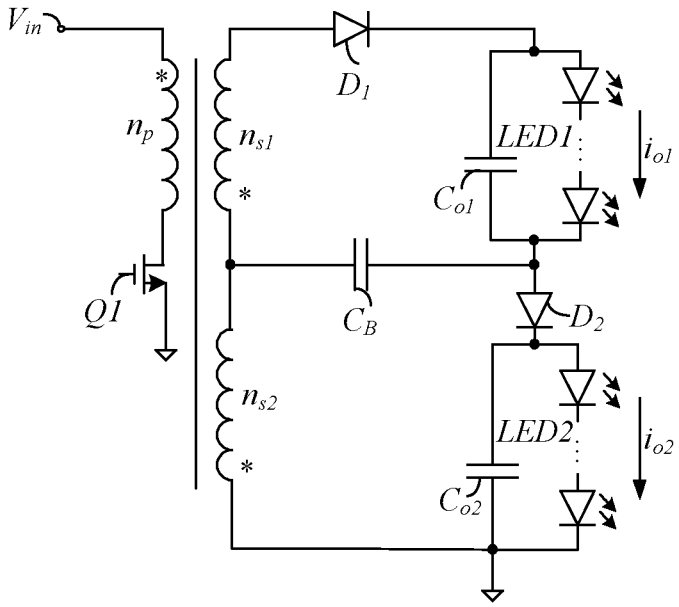
FIG. 3 is a schematic diagram of a first example multi-output self-balancing power circuit in accordance with embodiments of the present invention.

Referring now to FIG. 3, shown is a schematic diagram of a first example multi-output self-balancing power circuit in accordance with embodiments of the present invention. The multi-output self-balancing power circuit can include a transformer, two output circuits, and a current balancing capacitor $C_B$. Thus, in this example, "n" equals two.

The transformer can include primary winding $n_p$ and two secondary windings $n_{s1}$ and $n_{s2}$. A first input terminal of primary winding $n_p$ can be used to receive input voltage $V_{in}$, and a second input terminal can connect to ground via switch Q1. By controlling the state of switch Q1, the output current of power circuit can therefore be controlled. Two secondary windings $n_{s1}$, and $n_{s2}$, can connect in series. A first output terminal of each of two secondary windings $n_{s1}$, $n_{s2}$, and a second input terminal of primary winding $n_p$, can be "dotted" terminals. Alternatively, a second terminal of each of two secondary windings $n_{s1}$, $n_{s2}$, and a first input terminal of primary winding $n_p$ can be dotted terminals.

In circuit analysis, the "dot" convention is a convention denoting the polarity of two mutually inductive components, such as windings on a transformer. The polarity of the voltage across each inductor with respect to the dotted terminals may be the same. In an ideal transformer with no leakage inductance, the voltages across each winding are always proportional. When the current increases in the direction from the dot to the inductor, then positive voltage is induced at the dots of all the coupled inductors (including the original inductor due to self inductance). Alternatively, when current increases in the direction from the inductor to the dot (or, equivalently, decreases from the dot to the inductor), negative voltage is induced at the dots. If two mutually coupled inductors are in series, the dot convention can be used in the same manner as in the case of transformers. In the figures herein, dotted terminals are indicated by an asterisk or "*" character.

The output circuit with respect to secondary winding $n_{s1}$ can include series connected rectifier diode $D_1$ and filter capacitor $C_{o1}$. The other output circuit with respect to secondary winding $n_{s2}$ can include series coupled rectifier diode $D_2$ and filter capacitor $C_{o2}$. Loads LED1 and LED2 can be respectively coupled to filter capacitors $C_{o1}$ and $C_{o2}$ in parallel. The two output circuits with respect to secondary windings $n_{s1}$ and $n_{s2}$ can connect in series between the first output terminal of secondary winding $n_{s1}$ and the second output terminal of secondary winding $n_{s2}$.

That is, one terminal of filter capacitor $C_{o1}$ can connect to the cathode of rectifier diode $D_1$, and the other terminal of filter capacitor $C_{o1}$ can connect to the anode of rectifier diode $D_2$. Also, one terminal of filter capacitor $C_{o2}$ can connect to the cathode of rectifier diode $D_2$, and the other terminal of filter capacitor $C_{o2}$ can connect to the anode of rectifier diode $D_2$. Current balancing capacitor $C_B$ can connect between a common junction of secondary windings $n_{s1}$ and $n_{s2}$, and a common junction of two output circuits.

In practical applications, as the winding turns of secondary windings $n_{s1}$ and $n_{s2}$ are different, and loads of the multi-output circuits and impedance of conductor lines are different, the output currents of the multi-output circuits may also be different. As shown in FIG. 3, when currents $i_{o1}$ and $i_{o2}$ of LED1 and LED2 are unbalanced (e.g., if current $i_{o1}$ is larger than current $i_{o2}$), a difference between the currents can provide charge for current balancing capacitor $C_B$. Consequently, the voltage of current balancing capacitor $C_B$ can increase to lower a cross voltage of secondary winding $n_{s1}$. Thus, current $i_{o1}$ of LED1 can be reduced to be substantially equal to current $i_{o2}$.

From the above description, when two output voltages are unequal, current balancing capacitor $C_B$ can balance the voltage difference automatically based on the ampere-second characteristic, and as a result the currents of two outputs can be balanced. Here, withstand or breakdown voltages $V_{D1}$ and $V_{D2}$ of rectifier diodes $D_1$ and $D_2$ can be obtained from the following equations (1) and (2):

$$V_{D1}=V_{LED\text{-}1}-V_{CB}+V_{ns1} \tag{1}$$

$$V_{D2}=V_{LED\text{-}2}+V_{CB}+V_{ns2} \tag{2}$$

Here, $V_{LED\text{-}1}$ and $V_{LED\text{-}2}$ can indicate the respective voltages of LED1 and LED2, $V_{CB}$ can indicate the cross voltage of current balancing capacitor $C_B$, and $V_{ns1}$ and $V_{ns2}$ can indicate the cross voltages of respective secondary windings $n_{s1}$ and $n_{s2}$.

It can be seen from the above equations that by applying such multi-output circuit topology, a plurality of series connected LEDs can operate as different output loads. Also, the currents flowing through the LED strings can be substantially equal because of the current balancing capacitors, and as a result the brightness of the different LED strings can be substantially uniform. Also, withstand or breakdown voltages of rectifier diodes corresponding to different secondary windings can be reduced as compared to a single output circuit topology. Further, the filter capacitors parallel connected with the output load of each output channel may only need to withstand the output voltage of the corresponding output circuit.

Therefore, designer requirements can be met by applying rectifier diodes of relatively low withstand voltages, and relatively small bulk filter capacitors. In this way, the system transfer efficiency can be increased. In addition, the product costs and circuit volume can also be reduced, thus facilitating design and simplifying circuit structure.

Figure 4:
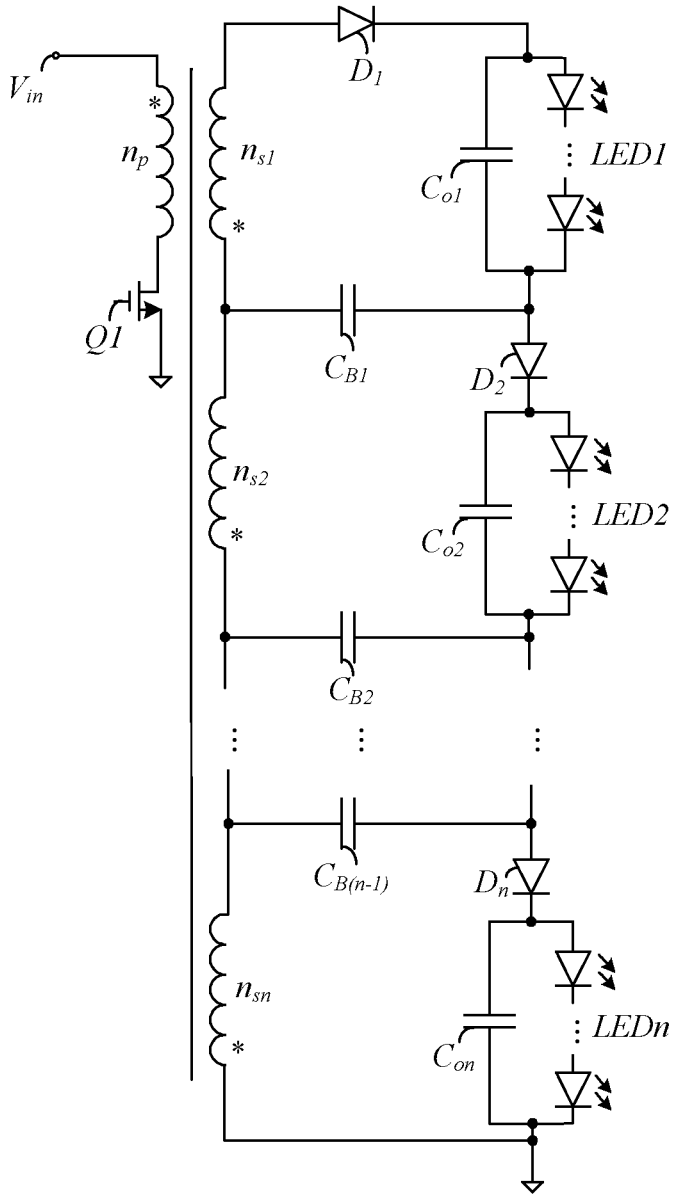
FIG. 4 is a schematic diagram of a second example multi-output self-balancing power circuit in accordance with embodiments of the present invention.

With reference to FIG. 4, shown is a schematic diagram of a second example multi-output self-balancing power circuit in accordance with embodiments of the present invention. Based on the example in FIG. 3, the quantity of the secondary windings and output circuits can be expanded to n, where n is a positive integer of at least two. The currents flowing through different LED strings can be balanced via the current balancing capacitors connected between the different output circuits, as discussed above.

In the examples shown in FIGS. 3 and 4, the loads connected with the different output circuits can be formed by one LED, or a plurality of series connected LEDs. Also, in practical applications, the loads can be various appropriate loads that may benefit from current balancing. In addition, the switch on the primary side can be controlled in a primary control mode, and can be operable in a boundary conduction mode (BCM) or a discontinuous conduction mode (DCM).

The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A multi-output self-balancing power circuit, comprising:

a) a transformer having a primary winding and n secondary windings, wherein a first input terminal of said primary winding is coupled to an input voltage, a second input terminal of said primary winding is coupled to ground via a switch, and an output current of said power circuit is configured to be controlled by states of said switch;

b) wherein said n secondary windings are coupled in series, wherein a first output terminal of each of said n secondary windings and said second input terminal of said primary winding are undotted terminals, and a second output terminal of each of said n secondary windings and said first terminal of said primary winding are dotted terminals, wherein n is a positive integer of at least two;

c) n output circuits corresponding to said n secondary windings, wherein each of said n output circuits comprises a rectifier diode and a filter capacitor that are sequentially coupled in series, and a load configured to be coupled in parallel with said filter capacitor, wherein said n output circuits are configured to be coupled in series between a first output terminal of a first secondary winding and a second output terminal of an $n^{th}$ secondary winding, said second output terminal of said $n^{th}$ secondary winding being coupled to ground; and d) (n−1) current balancing capacitors, wherein each current balancing capacitor is separately coupled between a common junction of two adjacent of said n secondary windings and a common junction of two adjacent of said n output circuits.

2. The self-balancing power circuit of claim 1, wherein said load comprises one or more series connected light-emitting diodes (LEDs).

3. The self-balancing power circuit of claim 1, wherein said switch is configured to be controlled in a primary control mode.

4. The self-balancing power circuit of claim 3, wherein said switch is configured to operate in a boundary conduction mode.

5. The self-balancing power circuit of claim 3, wherein said switch is configured to operate in a discontinuous conduction mode.

6. The self-balancing power circuit of claim 1, wherein said (n−1) current balancing capacitors are configured to balance currents such that currents of each said load are substantially equal.

* * * * *